US011394119B2

(12) United States Patent
Hamabe et al.

(10) Patent No.: US 11,394,119 B2
(45) Date of Patent: Jul. 19, 2022

(54) ANTENNA DEVICE

(71) Applicant: Panasonic Intellectual Property Management Co., Ltd., Osaka (JP)

(72) Inventors: Taichi Hamabe, Kanagawa (JP); Keisuke Noguchi, Nonoichi (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 71 days.

(21) Appl. No.: 16/912,937

(22) Filed: Jun. 26, 2020

(65) Prior Publication Data

US 2020/0328517 A1 Oct. 15, 2020

Related U.S. Application Data

(63) Continuation of application No. PCT/JP2018/048586, filed on Dec. 28, 2018.

(30) Foreign Application Priority Data

Dec. 28, 2017 (JP) ..... JP2017-253891

(51) Int. Cl.
*H01Q 9/04* (2006.01)
*H01Q 1/38* (2006.01)
*H01Q 13/08* (2006.01)

(52) U.S. Cl.
CPC ..... *H01Q 9/0407* (2013.01); *H01Q 1/38* (2013.01); *H01Q 13/08* (2013.01)

(58) Field of Classification Search
CPC ..... H01Q 1/38; H01Q 9/0407; H01Q 21/065
See application file for complete search history.

(56) References Cited

U.S. PATENT DOCUMENTS 4,843,400 A * 6/1989 Tsao ..... H01Q 9/0428 343/700 MS
5,376,942 A * 12/1994 Shiga ..... H01Q 1/247 343/700 MS
6,326,920 B1 * 12/2001 Barnett ..... H01Q 1/246 343/700 MS (Continued)

FOREIGN PATENT DOCUMENTS

JP 03-148902 6/1991
JP 2005-124056 5/2005

(Continued)

OTHER PUBLICATIONS

International Search Report dated Feb. 19, 2019 in International (PCT) Application No. PCT/JP2018/048586 with English translation.

(Continued)

*Primary Examiner* — Hasan Z Islam
(74) *Attorney, Agent, or Firm* — Wenderoth, Lind & Ponack, L.L.P.

(57) ABSTRACT

An antenna device includes an antenna surface provided with an antenna conductor, a ground surface opposed to the antenna surface and provided with a ground conductor, and a stub in which a plurality of transmission lines having different line widths are connected to each other in series. The stub is located in approximately the same plane as the antenna surface or between the antenna surface and the ground surface.

6 Claims, 10 Drawing Sheets

(56) References Cited

U.S. PATENT DOCUMENTS

| | | | | |
|---|---|---|---|---|
| 6,335,703 | B1 | 1/2002 | Chang et al. | |
| 2006/0097926 | A1* | 5/2006 | Fujii | H01Q 9/0442 343/700 MS |
| 2007/0257842 | A1* | 11/2007 | Tseng | H01Q 9/42 343/700 MS |
| 2012/0105302 | A1* | 5/2012 | Kato | H01Q 13/10 343/905 |
| 2019/0067834 | A1* | 2/2019 | Park | H01Q 19/005 |
| 2020/0365995 | A1 | 11/2020 | Hamabe | |

FOREIGN PATENT DOCUMENTS

| | | |
|---|---|---|
| JP | 2006-135672 | 5/2006 |
| WO | 2005/024998 | 3/2005 |
| WO | 2019/151529 | 8/2019 |

OTHER PUBLICATIONS

Shinji Nakano et al., "Wide Band Impedance Matching of a Polarization Diversity Patch Antenna by Use of Stubs Mounted on the Patch" Nov. 2003, The Transactions of the Institute of Electronics, Information and Communication Engineers B, vol. J86-B, No. 11, pp. 2,428-2,432.

Rowe et al., "Edge-Fed Patch Antennas With Reduced Spurious Radiation", IEEE Transactions on Antennas and Propagation, vol. 53, No. 5, May 2005, pp. 1785-1790.

Office Action dated Feb. 25, 2022 in U.S. Appl. No. 16/952,741.

* cited by examiner

ANTENNA DEVICE

BACKGROUND OF THE INVENTION

1. Field of the Invention

The present disclosure relates to an antenna device.

2. Description of the Related Art

Non-patent document 1 discloses, as a conventional antenna device installed in a mobile communication terminal, a patch antenna that uses a communication frequency in the 2 GHz band, for example. To widen the communication frequency range, this patch antenna has a three-layer structure in which a ground surface, an antenna surface, and a stub constituting a transmission line are provided in a lower layer, a middle layer, and an upper layer, respectively, which are laid one on another.

Non-patent document 1: Shinji Nakano and other four persons, "Wide Band Impedance Matching of a Polarization Diversity Patch Antenna by Use of Stubs Mounted on the Patch" November 2003, The Transactions of the Institute of Electronics, Information and Communication Engineers B, Vol. J86-B, No. 11, pp. 2,428-2,432.

SUMMARY OF THE INVENTION

The concept of the present disclosure has been conceived in view of the above circumstances in the art, and an object of the disclosure is therefore to provide an antenna device capable of widening the communication frequency range and increase the antenna gain by decreasing the Q value indicating the sharpness of a peak of a resonance frequency characteristic without increasing the overall thickness of the antenna device itself.

The present disclosure provides an antenna device including an antenna surface provided with an antenna conductor; a ground surface opposed to the antenna surface and provided with a ground conductor; and a stub in which a plurality of transmission lines having different line widths and the same line length are connected to each other in series, and the stub is located in approximately the same plane as the antenna surface or between the antenna surface and the ground surface.

The disclosure makes it possible to widen the communication frequency range and increase the antenna gain by decreasing the Q value indicating the sharpness of a peak of a resonance frequency characteristic without increasing the overall thickness of an antenna device itself.

DETAILED DESCRIPTION OF THE EXEMPLARY EMBODIMENTS

Background Leading to Embodiments

Figure 1:
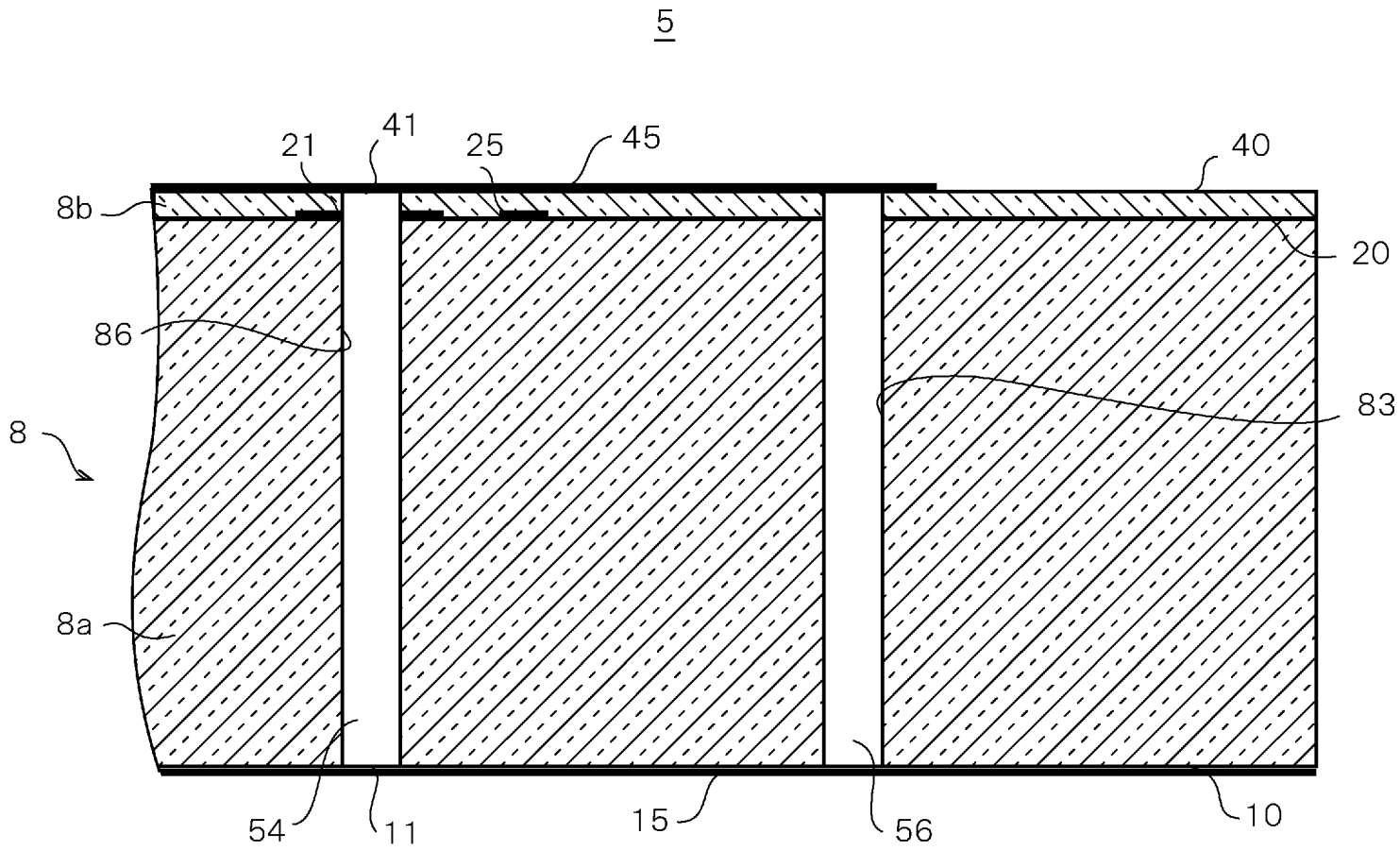
FIG. 1 is a sectional view showing a layered structure of a patch antenna according to a first embodiment.

In Non-patent document 1, the antenna surface has a copper foil patch provided on a surface of a dielectric. The patch forms a parallel resonance circuit that radiates radio waves. The ground surface has a ground conductor that is shaped from a metal plate into a shape that extends parallel with a housing of a mobile communication terminal. The stub has a transmission line provided on a surface of the dielectric and forms a series resonance circuit. Coupled with the patch in series, the stub can make the reactance component of the patch antenna close to zero and thereby widen the communication frequency range of the antenna device.

However, in the antenna device disclosed in Non-patent document 1, the antenna surface is interposed between the ground surface and the stub. This means a structure that the interval between the antenna surface and the ground surface is small and hence the Q value indicating the sharpness of a peak of a resonance frequency characteristic is increased, resulting in a problem that further bandwidth widening is difficult. On the other hand, the overall thickness of the antenna device itself is restricted to miniaturize the antenna device. As a result, in the configuration of the antenna device of Non-patent document 1, the interval between the antenna surface and the ground surface cannot be increased. In other words, it is difficult to reduce the Q value of the patch antenna, which makes it difficult to further widen the communication frequency range or increase the antenna gain.

Thus, an example antenna device capable of widening the communication frequency range and increasing the antenna gain by decreasing the Q value indicating the sharpness of a peak of a resonance frequency characteristic without increasing the overall thickness of the antenna device itself will be described in each of the following embodiments.

Each embodiment in which an antenna device according to the present disclosure will be disclosed in a specific manner will be described in detail by referring to the drawings when necessary. However, unnecessarily detailed descriptions may be avoided. For example, detailed descriptions of already well-known items and duplicated descriptions of constituent elements having substantially the same ones already described may be omitted. This is to prevent the following description from becoming unnecessarily redundant and thereby facilitate understanding of those skilled in the art. The following description and the accompanying drawings are provided to allow those skilled in the art to understand the disclosure thoroughly and are not intended to restrict the subject matter set forth in the claims.

An antenna device according to each of the following embodiments will be described for an example use that it is applied to a patch antenna (e.g., microstrip antenna) that is provided in a seat monitor installed in a seat of an airplane, for example. However, the device that is provided with the antenna device (patch antenna) is not limited to a seat monitor.

Embodiment 1

FIG. 1 is a sectional view showing a layered structure of a patch antenna 5 according to the first embodiment. FIG. 1 is a sectional view taken along an arrowed line E-E in FIG. 2 and an arrowed line F-F in FIG. 3. The patch antenna 5 has a substrate 8 having a three-layer structure in which a ground surface 10, a power supply surface 20, and an antenna surface 40 are provided in a lower layer, a middle layer, and an upper layer, respectively, which are laid one on another. The patch antenna 5 according to the first embodiment transmits a radio signal (in other words, radio waves) in, for example, the 2.4 GHz frequency band as an operative frequency band.

The substrate 8 is a dielectric substrate obtained by shaping a dielectric material having large relative permittivity such as PPO (polyphenylene oxide) and has a structure that a first substrate 8*a* and a second substrate 8*b* are laid on each other. The ground surface 10 is in the back surface of the first substrate 8*a*. The antenna surface 40 is in the front surface of the second substrate 8*b*. The power supply surface 20 is formed between the front surface of the first substrate 8*a* and the back surface of the second substrate 8*b*. Thus, in the patch antenna 5 according to the first embodiment, the antenna surface 40 is supplied with power from the power supply surface 20 by bottom surface energization. The total thickness of the substrate 8 is 3 mm, for example. The thickness of the first substrate 8*a* is 2.9 mm, for example. The thickness of the second substrate 8*b* is 0.1 mm, for example. A wireless communication circuit (not shown) for supplying power to the patch antenna 5 is provided on the back side of the substrate 8 (i.e., on the back side of the ground surface 10).

Via conductors 54 and 56 are formed in respective through-holes 86 and 83 which penetrate through the substrate 8 from its front surface (i.e., antenna surface 40) to its back surface (i.e., ground surface 10). The via conductors 54 and 56 are formed in cylindrical shape by charging a conductive material into the through-holes 86 and 83. The via conductor 54 is a single conductor for electrically connecting a contact 41 (i.e., the top end surface of the via conductor 54) formed on the antenna surface 40, a power supply point 21 (i.e., an intermediate cross section of the via conductor 54) formed on the power supply surface 20, and a contact 11 (i.e., the bottom end surface of the via conductor 54) formed on the ground surface 10. The via conductor 54 is a power supply conductor for driving the antenna surface 40 so that it serves as a patch antenna. The contact 11 is connected to a power supply terminal of the wireless communication circuit (not shown) provided on the side of the back surface of the substrate 8.

The via conductors 56 are plural conductors for electrically connecting a patch 45 (an example of a term "antenna conductor") formed on the antenna surface 40 to a ground conductor 15 formed on the ground surface 10. The via conductors 56 are not electrically connected to anything existing on the power supply surface 20 and are merely inserted through the power supply surface 20. The plural through-holes 83 generated on the power supply surface 20 penetrate through the power supply surface 20.

Figure 2:
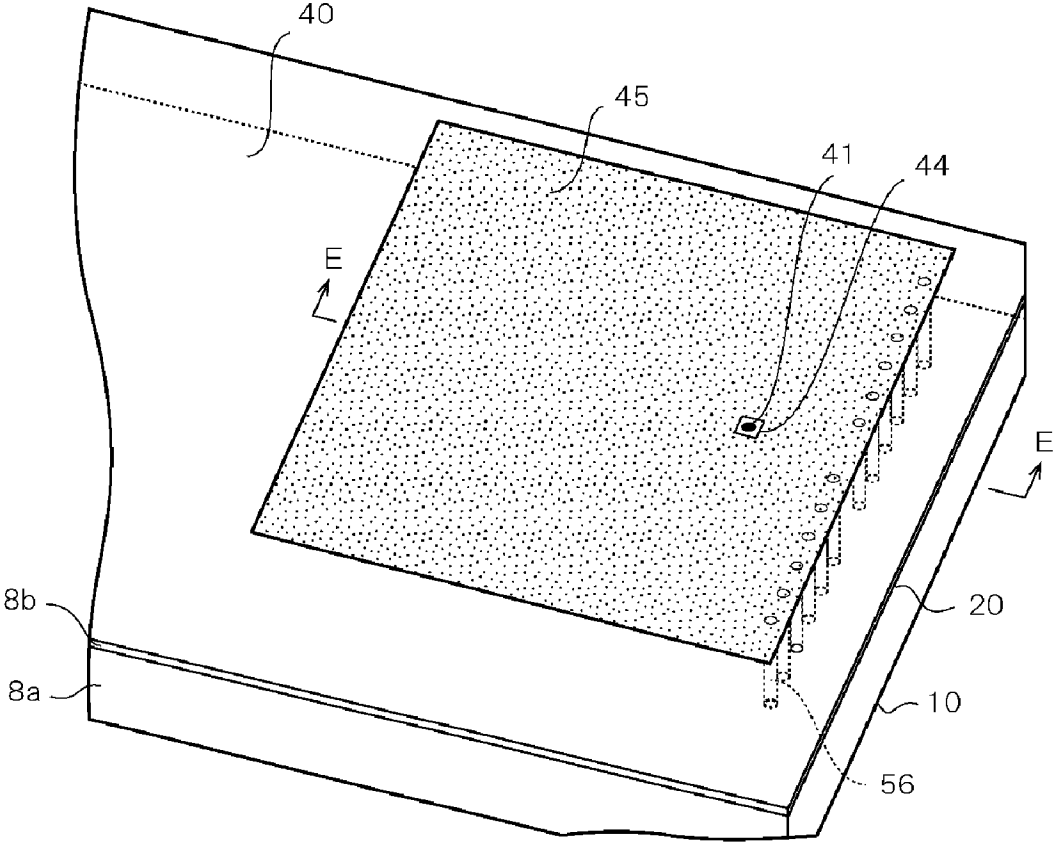
FIG. 2 is a perspective view showing an antenna surface.

FIG. 2 is a perspective view showing the antenna surface 40. The patch 45, which is an example of an antenna conductor for the 2.4-GHz band, is formed on the antenna surface 40. The patch 45 is a rectangular copper foil. An opening 44 is formed at one position in the planar patch 45 and the contact 41 (i.e., the top end surface of the via conductor 54) is exposed in the opening 44 at the center. The patch 45, which has a characteristic of a parallel resonance circuit, radiates a radio signal (i.e., radio waves) according to an excitation signal that is supplied from the wireless communication circuit (not shown) to the power supply point 21 of a stub 25.

Figure 3:
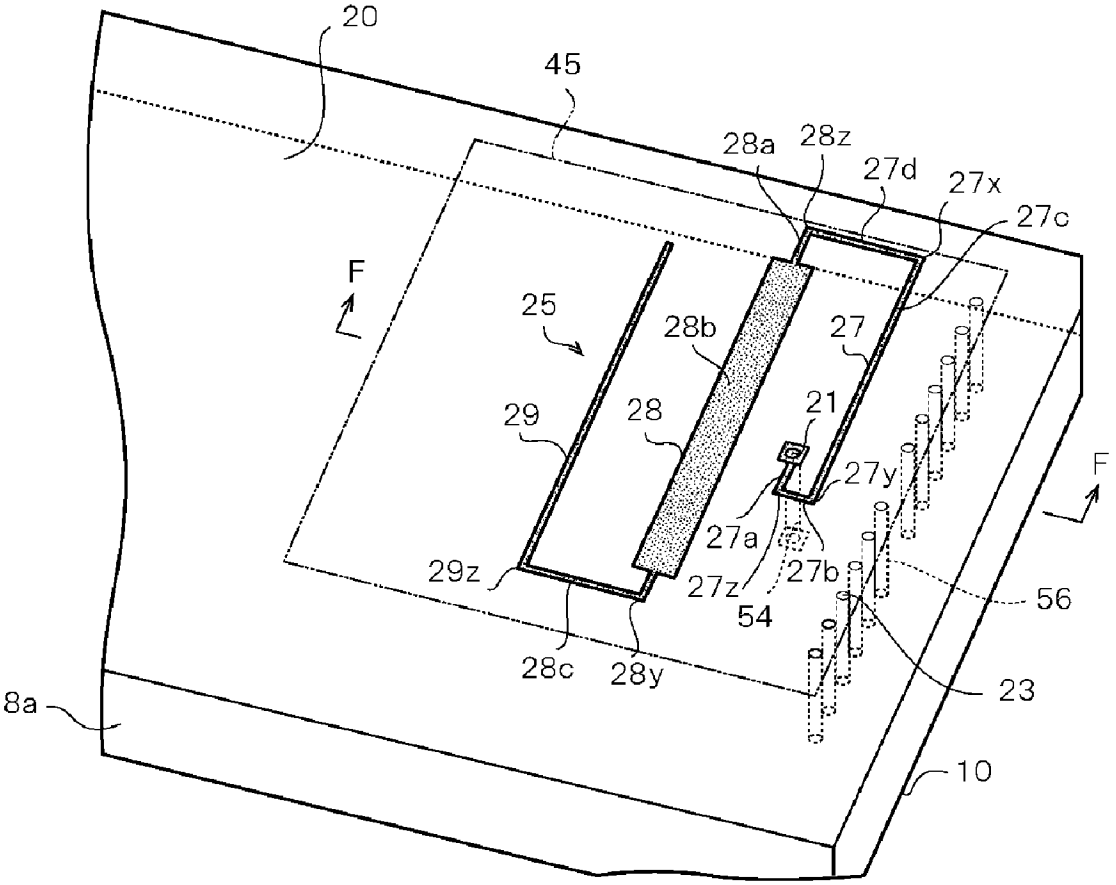
FIG. 3 is a perspective view showing a power supply surface.

FIG. 3 is a perspective view showing the power supply surface 20. The stub 25 (an example of a term "power supply line") is formed on the power supply surface 20. The stub 25 has a characteristic of a series resonance circuit that is connected to the patch 45 in series to take impedance matching of the patch antenna 5 that is suitable for an operation target frequency band. That is, the stub 25 can make the radiation reactance component of the patch antenna 5 close to zero by coupling with the patch 45 in series electrically.

Figure 4:
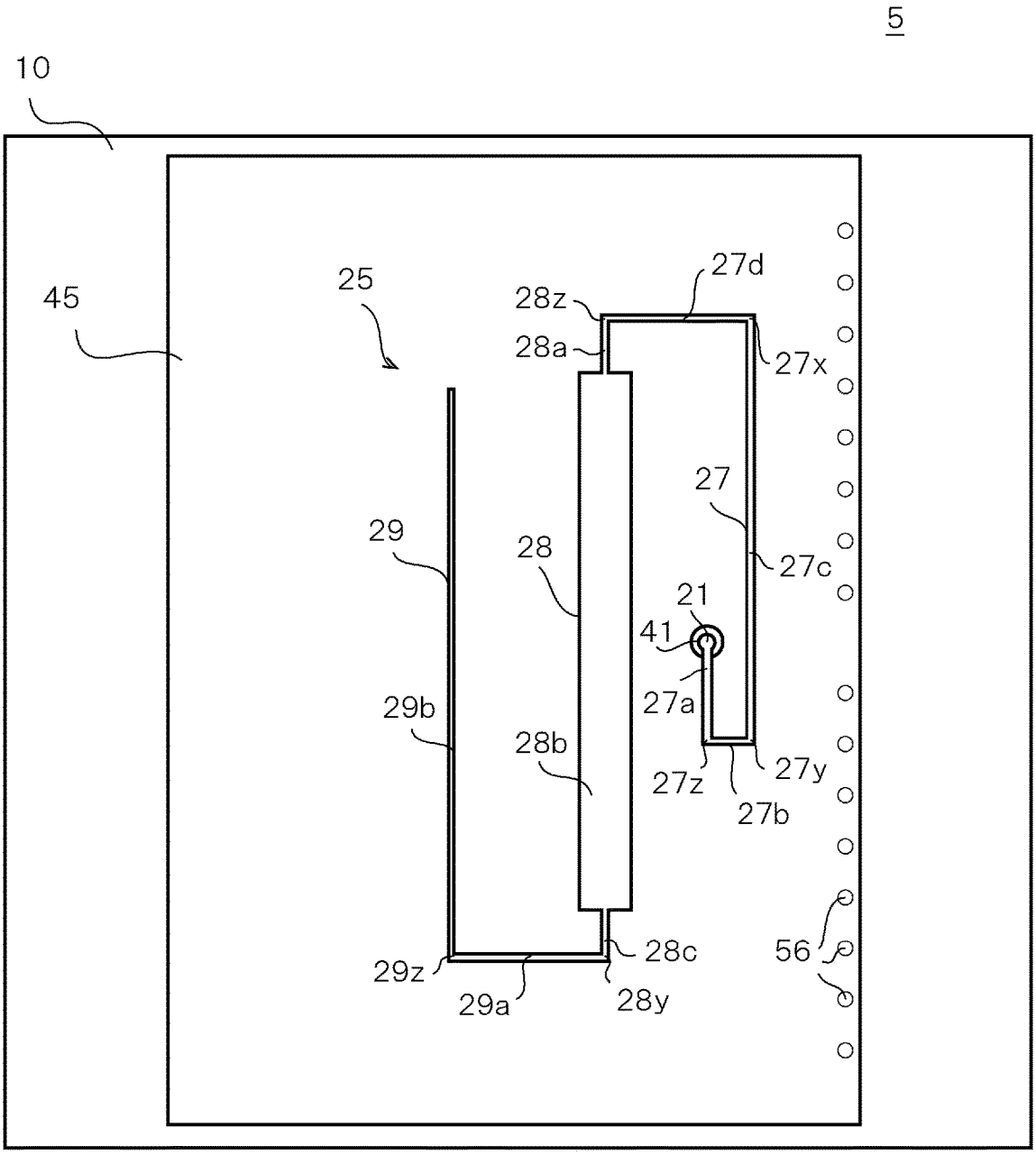
FIG. 4 is a see-through plan view, as viewed from above the patch antenna, showing shapes of the patch and the stub.

FIG. 4 is a see-through plan view, as viewed from above the patch antenna 5, showing the shapes of the patch 45 and the stub 25. The stub 25 has a shape that the power supply point 21, a first transmission line 27, a second transmission line 28, a third transmission line 29 are connected to each other in series. The lengths of the first transmission line 27, the second transmission line 28, and the third transmission line 29 are the same and equal to $\lambda/4$ ($\lambda$: a wavelength corresponding to a resonance frequency) and the overall length of the stub 25 is equal to $3\lambda/4$. The lengths (line lengths) of the first transmission line 27, the second transmission line 28, and the third transmission line 29 need not always be the same.

The first transmission line 27 has four lines 27*a*, 27*b*, 27*c*, and 27*d*, and starts from the power supply point 21 and are then bent (approximately) perpendicularly at three bending portions 27*z*, 27*y*, and 27*x*. The four lines 27*a*, 27*b*, 27*c*, and 27*d* have the same line width.

The second transmission line 28 has three lines 28*a*, 28*b*, and 28*c* and is bent (approximately) perpendicularly at two bending portions 28*z* and 28*y*. The second transmission line 28 includes the straight line 28*b* which is larger in line width than the first transmission line 27 and the third transmission line 29. The two lines 28*a* and 28*c* and the four lines 27*a*-27*d* have the same line width.

The third transmission line 29 has two lines 29*a* and 29*b*, and are bent (approximately) perpendicularly at one bending portion 29*z* and terminates at an end point. The two lines 29*a* and 29*b* have the same line width.

The first transmission line 27 may further have the line 28*a* including the bending portion 28*z* in addition to the four lines 27*a*-27*d*. Likewise, the third transmission line 29 may further have the line 28*c* including the bending portion 28*y* in addition to the two lines 29*a* and 29*b*. In this case, the stub 25 is configured by three transmission lines that have different line widths and the sane line length. They need not always have the same line length.

Figure 5:
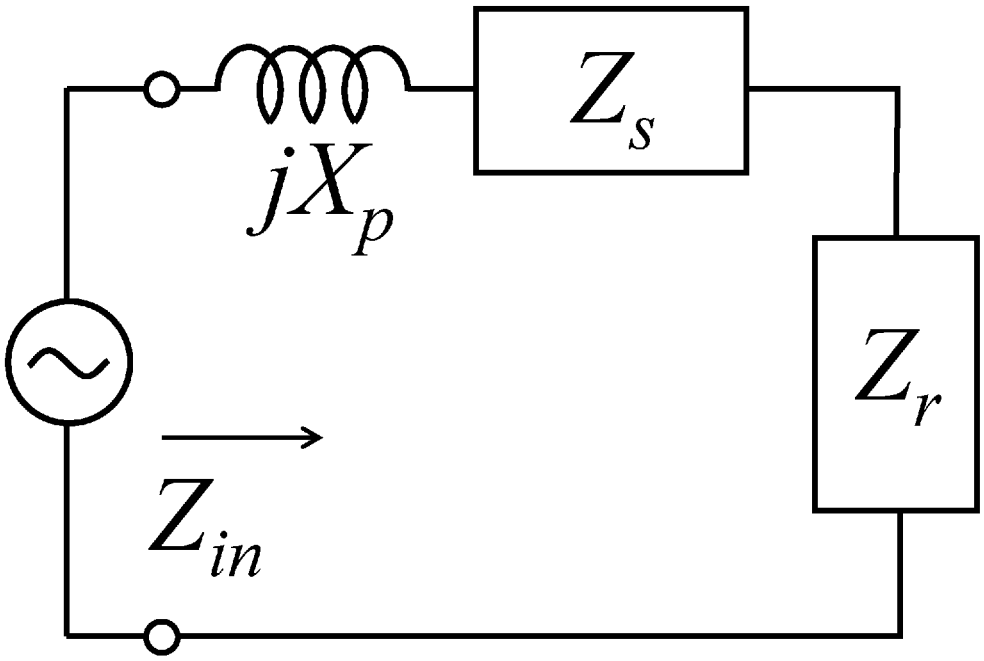
FIG. 5 is a diagram showing an example equivalent circuit of the patch antenna.

FIG. 5 is a diagram showing an example equivalent circuit of the patch antenna 5. As shown in FIG. 5, the equivalent circuit of the patch antenna 5 is a circuit that is a series connection of an impedance Zr, an impedance Zs, and a reactance jXp. The impedance Zr is an impedance component that contributes to the radiation of the patch 45. The impedance Zs is an impedance component of the series resonance circuit of the stub 25. The reactance jXp is a reactance component of a probe for power supply. The probe for power supply is a conductor that extends from the power supply terminal of the wireless communication circuit (not shown) to the power supply point 21 past the contact 11 and the via conductor 54.

Figure 6:
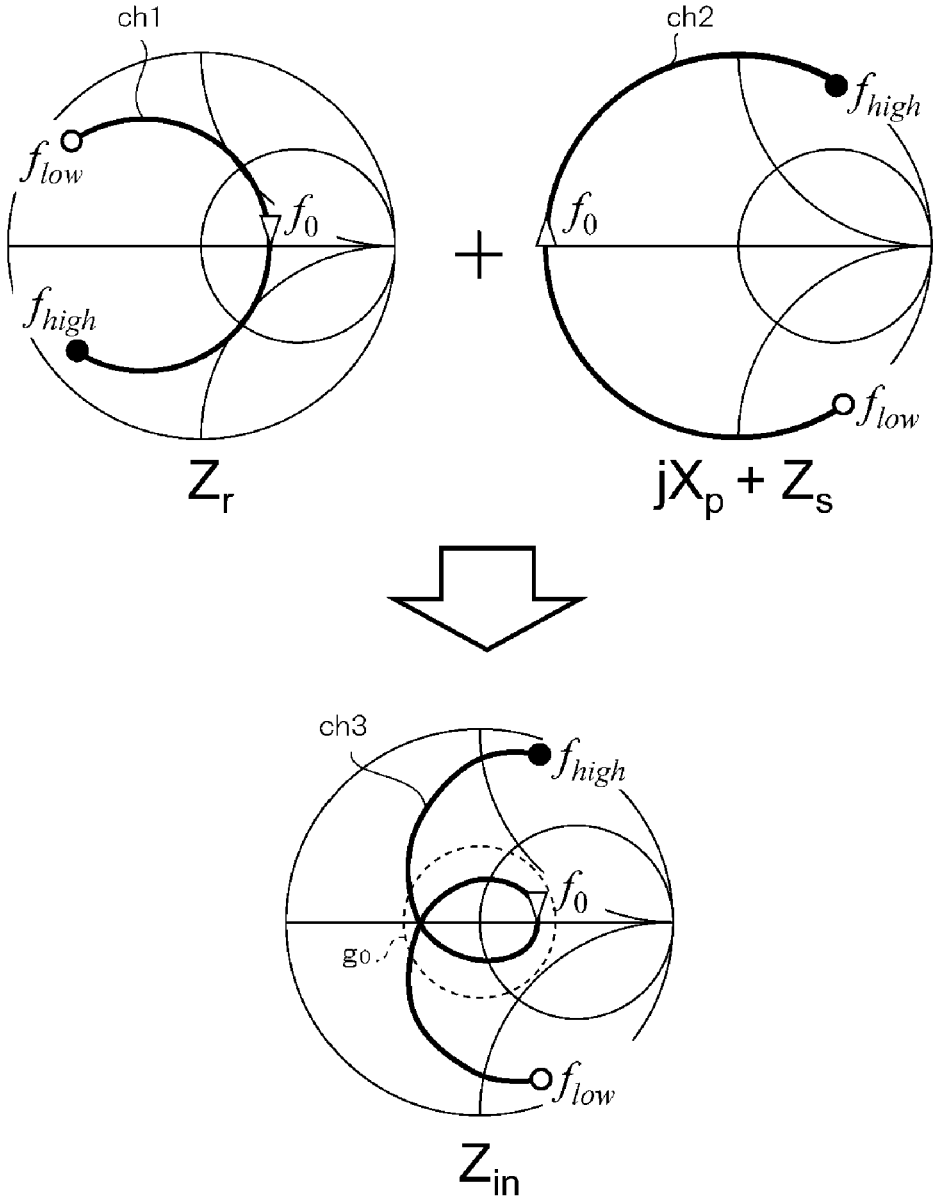
FIG. 6 is a diagram illustrating, using a Smith chart, how the bandwidth of the patch antenna is widened.

FIG. 6 is a diagram illustrating, using a Smith chart, how the bandwidth of the patch antenna 5 is widened. The Smith chart represents the entire complex impedance space.

Curves ch1 and ch2 represent impedance characteristics showing how the impedance Zr and an impedance jXp+Zs vary, respectively, with a frequency variation of a signal supplied from the power supply point 21.

As indicated by the curve Ch1, the impedance Zr which contributes to radiation is an impedance that undergoes parallel resonance at a frequency $f_0$ in a frequency range $f_{low}$ (e.g., 1.8 GHz) to $f_{high}$ (e.g., 2.8 GHz). As indicated by the curve ch2, the impedance jXp+Zs is an impedance that undergoes series resonance at a frequency $f_0$ in the frequency range $f_{low}$ to $f_{high}$.

The input impedance Zin of the patch antenna 5 has a value of a series connection of the impedance Zr and the jXp+Zs (i.e., the sum of them). As the frequency varies from $f_{low}$ to $f_{high}$, a curve ch3 that represents the input impedance Zin comes close to the center (i.e., an impedance value (e.g., 50Ω or 75Ω) as an impedance matching impedance value (prescribed set value) of the Smith chart at the frequency $f_0$ as it goes around the center one time. In the region where the curve ch3 comes close to the center, the reactance components cancel out each other and the input impedance Zin comes close to zero. That is, a circle $g_0$ having the center of the Smith chart as its center includes many impedances in a frequency range in which the voltage standing wave ratio (VSWR) is smaller than or equal to 2.0, for example, whereby the operative communication frequency range of the patch antenna 5 can be widened.

As described above, the patch antenna 5 according to the first embodiment is equipped with the antenna surface 40 which is provided with the patch 45, the ground surface 10 which is opposed to the antenna surface 40 and is provided with the ground conductor 15, and the stub 25 in which the first transmission line 27 to the third transmission line 29 that have different line widths are connected to each other in series. The stub 25 is located in approximately the same plane as the antenna surface 40 or between the antenna surface 40 and the ground surface 10.

With this configuration, in contrast to the above-described patch antenna disclosed in Non-patent document 1, the patch antenna 5 according to the first embodiment can widen the interval between the antenna surface 40 and the ground surface 10 without increasing the overall thickness of the patch antenna 5 itself. Thus, in the patch antenna 5, the Q value indicating the sharpness of a peak of a resonance frequency characteristic can be decreased. In other words, the Q value at a communication frequency can be decreased without increasing the thickness of the patch antenna 5. The radio wave frequency range in which the patch antenna 5 can operate can be widened by decreasing the Q value. Furthermore, the degree of radio wave reflection is lowered by the bandwidth widening, whereby the antenna gain (i.e., communication power gain) can be increased.

The plurality of transmission lines (first transmission line 27 to third transmission line 29) have the same line length. With this measure, since all of the first transmission line 27 to the third transmission line 29 have the same line length, impedance matching for obtaining a prescribed impedance suitable for the resonance frequency can be attained in the stub 25 by adjusting the line widths and hence the impedance matching can be simplified.

The substrate 8 is configured by the first substrate 8*a* and the second substrate 8*b* that is a layer located above the first substrate 8*a*. The ground surface 10 is the back surface of the first substrate 8*a*. The antenna surface 40 is in the front surface of the second substrate 8*b*. The power supply surface 20 is provided between the front surface of the first substrate 8*a* and the back surface of the second substrate 8*b*. In this manner, the patch antenna 5 has a three-layer structure in which the antenna surface 40 is in a top layer and the power supply surface 20 is in an intermediate layer. With this measure, the stub 25 which is formed on the power supply surface 20 is electromagnetically coupled with the patch 45 in the direction perpendicular to the antenna surface 40 (i.e., the top-bottom direction in the paper surface of FIG. 1) and can supply power to the patch 45 formed on the antenna surface 40. Furthermore, the reactance component of the series resonance circuit of the stub 25 can cancel out the radiation reactance component of the parallel resonance of the antenna surface 40. Thus, the transmission frequency range of radio waves transmitted from the patch antenna 5 can be widened. Furthermore, the gain of communication power is increased because of reduction in the degree of reflection of radio waves.

In the patch antenna 5, the line width of the first transmission line 27 that is closest to the power supply point 21 disposed in the stub 25 among the first transmission line 27, the second transmission line 28, and the third transmission line 29 is smaller than the line width of the second transmission line 28 that is connected to the first transmission line 27 in series. With this measure, since the line width of the first transmission line 27 located on the side of the power supply point 21 is small, the transmission lines can be routed easily. Narrowing the first transmission line 27 that is closest to the power supply point 21 and thereby increasing its impedance is effective for the impedance matching.

The stub 25 has at least one bending portion for arranging portions of the same transmission line or different transmission lines parallel with each other in the first transmission line 27, the second transmission line 28, and the third transmission line 29. Since in this manner the transmission lines have at least one bending portion, their overall length can be kept short even if their line length is made large. Furthermore, the strength of electromagnetic coupling between the stub 25 and the patch 45 can be increased.

Embodiment 2

The first embodiment is directed to the patch antenna that performs transmission at the frequency 2.4 GHz. In a second embodiment, an example of a patch antenna capable of transmission at two frequencies 2.4 GHz and 5 GHz will be described.

Figure 7:
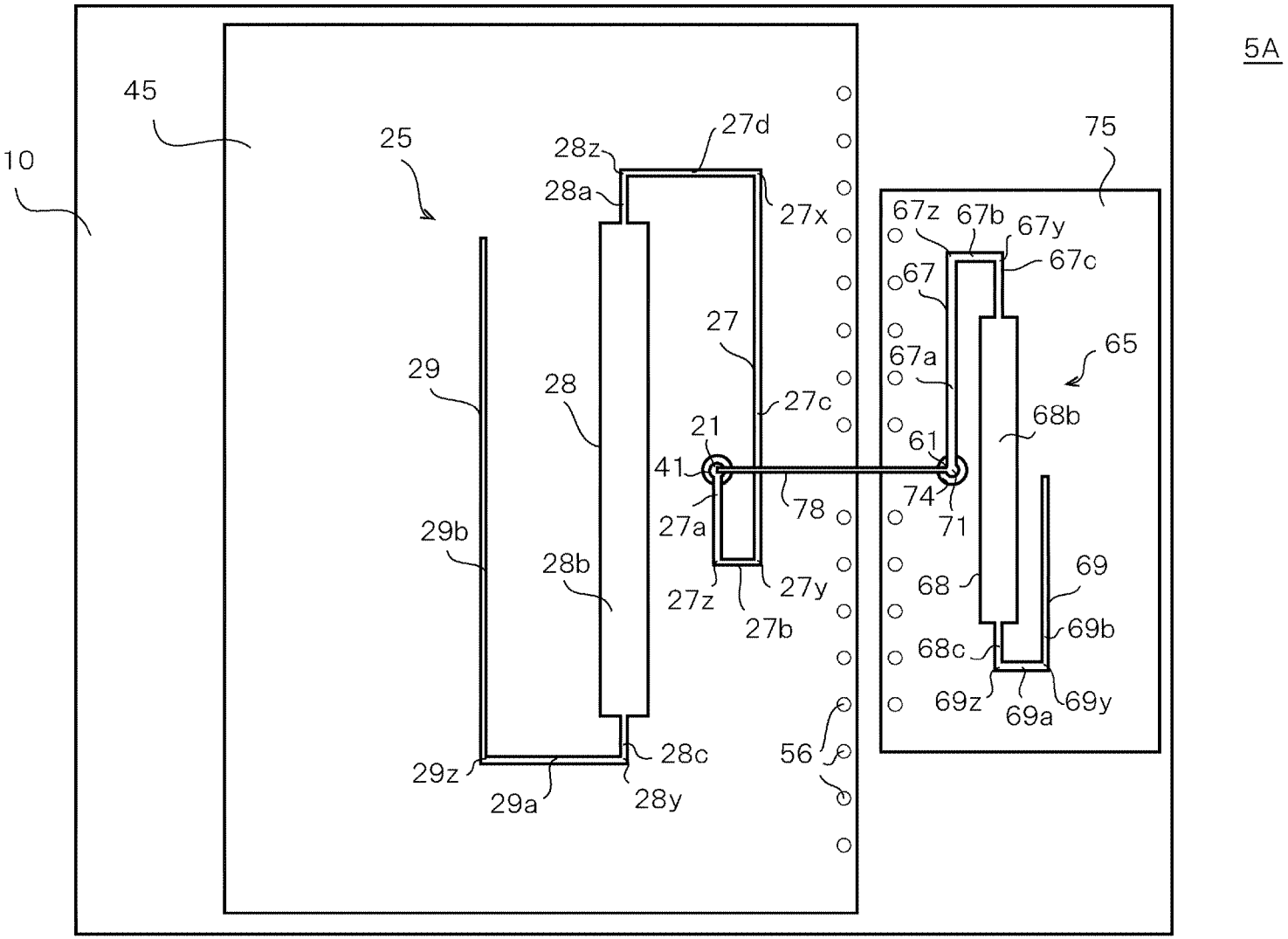
FIG. 7 is a see-through plan view, as viewed from above a patch antenna, showing shapes of patches and stubs employed in a second embodiment.

FIG. 7 is a see-through plan view, as viewed from above a patch antenna 5A, showing the shapes of patches 45 and 75 and stubs 25 and 65.

The patch 45 for 2.4 GHz and the patch 75 for 5 GHz are formed on an antenna surface 40 that is in the front surface of the second substrate 8*b*. A stub 25 for 2.4 GHz and a stub 65 for 5 GHz are formed on a power supply surface 20 which is provided between the back surface of the second substrate 8*b* and the front surface of the first substrate 8*a*.

The patch 45 and the stub 25 for 2.4 GHz are the same as those employed in the first embodiment. Constituent elements having the same ones already described will be given the same reference symbols as the latter and their descriptions will be simplified or omitted; only differences will be described below.

On the other hand, the patch 75 for 5 GHz is a rectangular copper foil that is smaller in area than the patch 45. An opening 74 is formed at one position in the planar patch 75 and a contact 71 is formed in the opening 74 at the center. The contact 71 is electrically connected to a power supply point 61 of the stub 65 via a via conductor (not shown). The contact 71 is connected, by a connection line 78, to the contact 41 which is provided in the patch 45. The contact 41, which is the top end surface of the via conductor 54, is electrically connected to the power supply point 21. In this manner, the power supply point 21 for 2.4 GHz is electrically connected to the power supply point 61 for 5 GHz via the via conductor 54, the contact 41, the connection line 78, the contact 71, and the via conductor (not shown).

Like the patch 45 for 2.4 GHz, the patch 75 for 5 GHz has a characteristic of a parallel resonance circuit and radiates radio waves according to an excitation signal that is supplied from a wireless communication circuit (not shown) via the power supply point 61.

Like the patch 45 for 2.4 GHz, the stub 65 for 5 GHz has a shape that that the power supply point 61, a first transmission line 67, a second transmission line 68, a third transmission line 69 are connected together in series. The lengths of the first transmission line 67, the second transmission line 68, and the third transmission line 69 are the same and equal to $\lambda/4$ ($\lambda$: a wavelength corresponding to a resonance frequency) and the overall length of the stub 65 is equal to $3\lambda/4$. Since the wavelength corresponding to 5 GHz is shorter than that corresponding to 2.4 GHz, the overall length of the stub 65 for 5 GHz is shorter than that of the stub 45 for 2.4 GHz.

The first transmission line 67 has three lines 67*a*, 67*b*, and 67*c*, and starts from the power supply point 61 and are then bent (approximately) perpendicularly at two bending portions 67*z* and 67*y*. The three lines 67*a*-67*c* have the same line width.

The second transmission line 68 has two lines 68*b* and 68*c* and includes the straight line 68*b* which is larger in line width than the first transmission line 67 and the third transmission line 69.

The third transmission line 69 has two lines 69*a* and 69*b*, and are bent (approximately) perpendicularly at two bending portions 69*z* and 69*y* and terminates at an end point. The third transmission line 69 may further have the line 68*c* including the bending portion 69*z* in addition to the two lines 69*a* and 69*b*. In this case, the stub 65 is configured by three transmission lines having different line widths.

As described above, in the patch antenna 5A according to the second embodiment, the plural antenna conductors (patches 45 and 75) capable of operating in different frequency bands (e.g., 2.4 GHz band and 5 GHz band) are formed separately from each other on the antenna surface 40 which is in the front surface of the second substrate 8*b*. Furthermore, in the second embodiment, the plural sub-stubs (e.g., stubs 25 and 65) are provided on the power supply surface 20 which is in the back surface of the second substrate 8*b*, so as to be impedance-matched corresponding to the plural respective patches 45 and 75. With these measures, patch antennas capable of transmission in two respective bands can be constructed using the single patch antenna. Furthermore, since it is not necessary to implement plural patch antennas for respective frequency bands, the number of components can be reduced and the cost can be suppressed.

Incidentally, although the second embodiment is directed to the case that the patch and the stub for 2.4 GHz and the patch and the stub for 5.0 GHz are provided on the substrate of the single patch antenna, patches and stubs for three or more frequency bands may be provided on a substrate of a single patch antenna.

Embodiment 3

In the first and second embodiments, the patch antenna 5, 5A has the three-layer structure consisting of the antenna surface (upper layer), the power supply surface (middle layer), and the ground surface (lower layer). In a third embodiment, an example of a patch antenna having a two-layer structure in which an antenna surface and a power supply surface belong to the same surface will be described.

Figure 8:
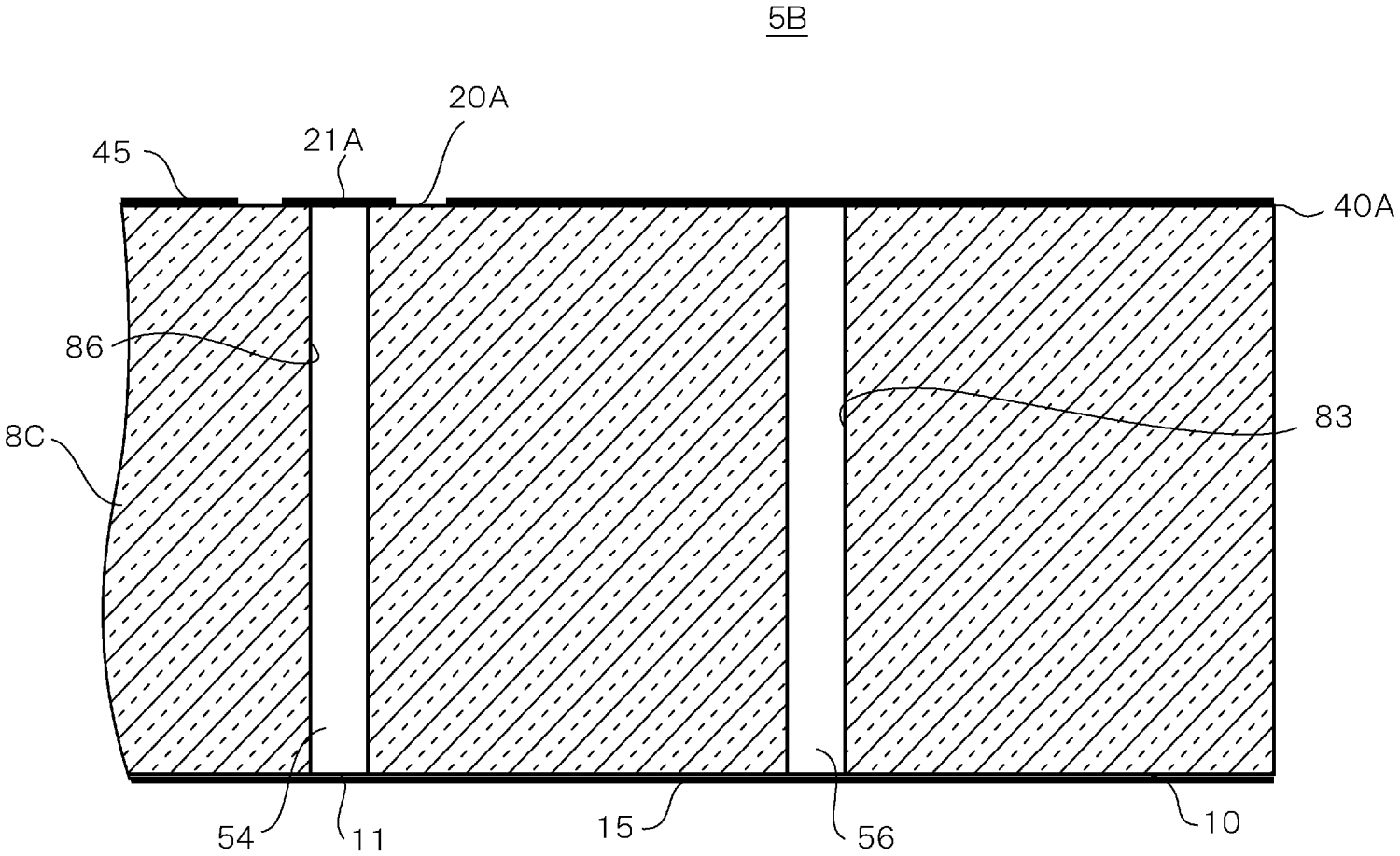
FIG. 8 is a sectional view showing the configuration of a patch antenna according to a third embodiment.

FIG. 8 is a sectional view showing the configuration of a patch antenna 5B according to the third embodiment. FIG. 8 is a sectional view taken along an arrowed line G-G in FIG. 9. The patch antenna 5B has a two-layer structure in which a ground surface 10 is provided in a lower layer and a power supply surface 20A and an antenna surface 40A are provided in an upper layer that is laid on the lower layer. The power supply surface 20A and the antenna surface 40A are in the front surface (same surface) of a substrate 8C.

Figure 9:
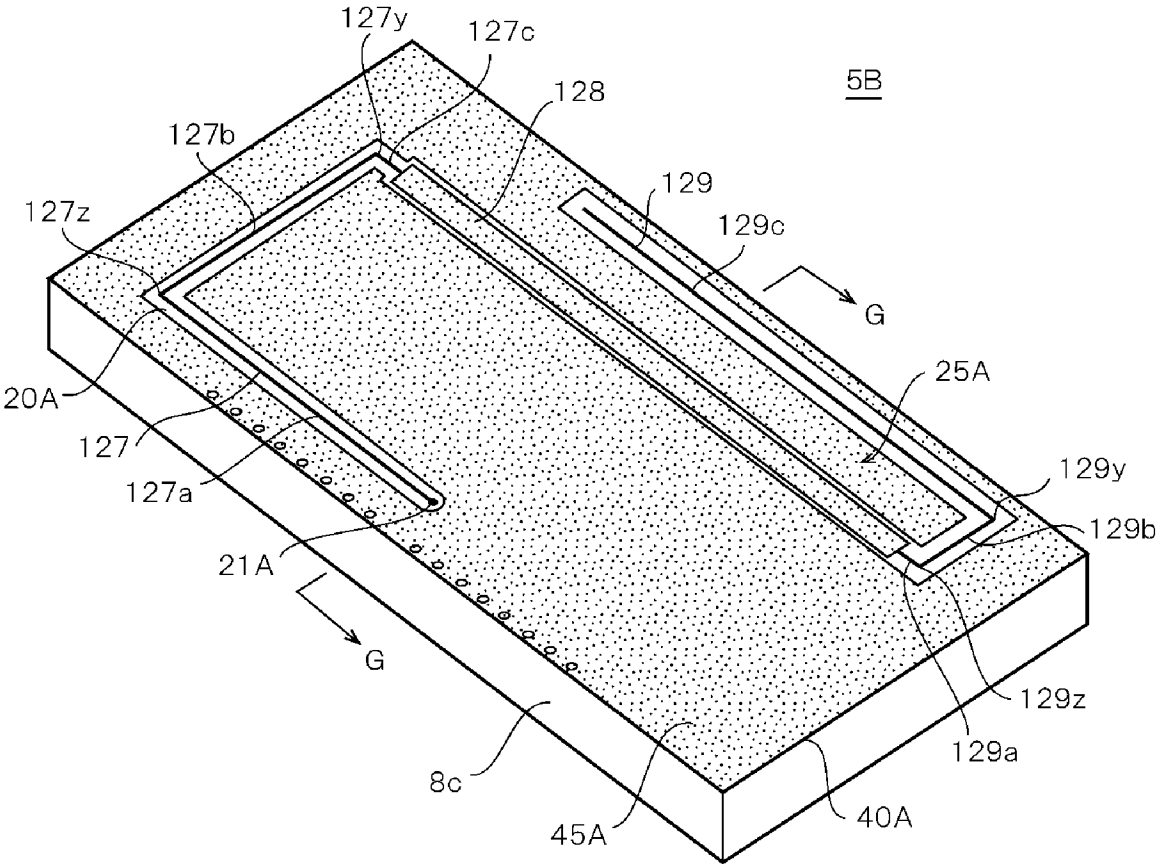
FIG. 9 is a perspective view showing a patch and a stub provided on the front surface of a substrate.

FIG. 9 is a perspective view showing a patch 45A and a stub 25A which are formed on the front surface of the substrate 8C. The patch 45A for 2.4 GHz, for example, is formed on an antenna surface 40A which is in the front surface of the substrate 8C. A power supply surface 20A that is separated from the antenna surface 40A and bears the stub 25A having a bent shape is formed on the front surface of the substrate 8C inside the antenna surface 40A.

The patch 45A is a rectangular copper foil obtained by removing an inside portion located on the antenna surface 40A to form a power supply surface 20A. On the other hand, the stub 25A provided on the power supply surface 20A has a shape that a power supply point 21A, a first transmission line 127, a second transmission line 128, and a third transmission line 129 are connected to each other in series. The lengths of the first transmission line 127, the second transmission line 128, and the third transmission line 129 are the same and equal to $\lambda/4$ ($\lambda$: a wavelength corresponding to a resonance frequency) and the overall length of the stub 25A is equal to $3\lambda/4$. The lengths (line lengths) of the first transmission line 127, the second transmission line 128, and the third transmission line 129 need not always be such example lengths.

The first transmission line 127 has three lines 127*a*, 127*b*, and 127*c*, and starts from the power supply point 21A and are then bent (approximately) perpendicularly at two bending portions 127*z* and 127*y*. The three lines 127*a*-127*c* have the same line width.

The second transmission line 128 is a straight line which is larger in line width than the first transmission line 127 and the third transmission line 129.

The third transmission line 129 has three lines 129*a*, 129*b*, and 129*c*, and are bent (approximately) perpendicularly at two bending portions 129*z* and 129*y* and terminates at an end point. The three lines 129*a*-129*c* have the same line width. That is, the stub 25A is configured by the three transmission lines having different line widths.

The stub 25A is electromagnetically coupled with the patch 45A formed on the antenna surface 40A in in-plane directions (the left-right direction in the paper surface of FIG. 9) and supplies power to the patch 45A formed on the antenna surface 40A. Having a characteristic of a parallel resonance circuit, the patch 45A radiates a radio signal (i.e., radio waves) according to an excitation signal that is supplied from a wireless communication circuit (not shown) via the power supply point 21A.

The stub 25A has a characteristic of a series resonance circuit that is connected to the patch 45A in series to take impedance matching of the patch antenna 5 that is suitable for an operation target frequency band. That is, the stub 25A can make the radiation reactance component of the patch antenna 5B close to zero by coupling with the patch 45A in series electrically.

An equivalent circuit of the patch antenna 5A according to the third embodiment is the same as the equivalent circuit (see FIG. 5) of the patch antenna 5 according to the first embodiment. A description of the configuration of this circuit will not be made because it is therefore the same as of the circuit of the first embodiment.

Figure 10:
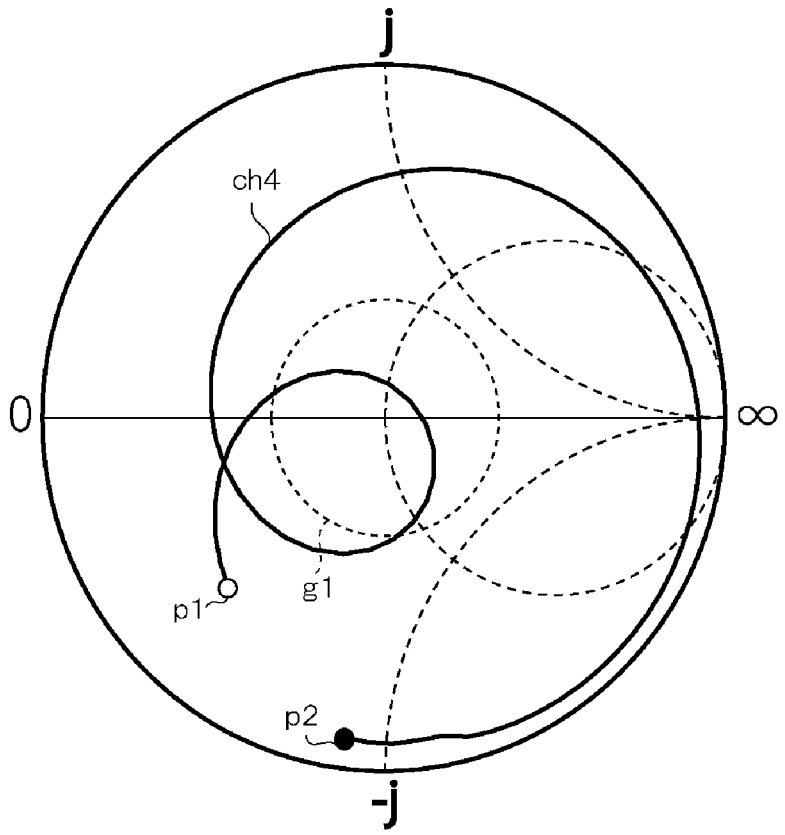
FIG. 10 is a Smith chart showing an impedance characteristic of the patch antenna.

FIG. 10 is a Smith chart showing an impedance characteristic of the patch antenna 5B. A curve ch4 indicates how the input impedance Zin of the patch antenna 5B varies with a variation of the frequency of a signal supplied from the power supply point. In the curve ch4, an end point p1 represents an input impedance of a case that the frequency of a signal supplied from the power supply point 21A is 2.0 GHz. An end point p2 represents an input impedance of a case that the frequency of a signal supplied from the power supply point 21A is 3.0 GHz. The curve ch4 starts from the end point p1, comes close to the center of the Smith chart as it goes around the center one time, and goes toward the end point p2 so as to form a large arc.

A circle g1 (broken line) having, as its center, the center (i.e., an impedance value (e.g., 50Ω or 75Ω) as a prescribed set value at which impedance matching is attained) of the Smith chart includes many impedances in a frequency range in which the voltage standing wave ratio (VSWR) is smaller than or equal to 2.0, for example. That is, inside the circle g1, communication frequencies can be used at which the degree of reflection of radio waves is low. Thus, the communication frequency range of the patch antenna 5B can be widened. Furthermore, the widening of the communication frequency range leads to increase of communication power.

As described above, in the patch antenna 5B according to the third embodiment, both of the patch 45A (antenna conductor) formed on the antenna surface 40 and the stub 25A formed on the power supply surface 20 are provided on the front surface (one surface) of the substrate 8. The patch antenna 5B has the two-layer structure in which the antenna surface 40 and the power supply surface 20 are in the upper layer. With this configuration, the stub 25A formed on the power supply surface 20 is electromagnetically coupled with the antenna surface 40 in the left-right direction and can supply power to the patch 45A formed on the antenna surface 40. To take impedance matching of the patch antenna 5A, the stub 25A has a characteristic of a series resonance circuit that is connected to the patch 45A in series. That is, the stub 25A is coupled with the patch 45A in series and brings the reactance component of the patch antenna 5B close to zero. Thus, the communication frequency range of radio waves transmitted from the patch antenna 5B can be widened. Furthermore, the bandwidth widening lowers the degree of reflection of radio waves and increases the gain of communication power.

Since the antenna surface 40 and the power supply surface 20 are in the front surface of the substrate 8, the patch antenna 5A according to the third embodiment provides the following advantages. For example, the length of a transmission line (power supply line) can be adjusted easily to attain impedance matching before the patch antenna 5A is installed in a product (e.g., a seat monitor as mentioned above). Where the transmission line exists in a middle layer, there may occur an event that it is difficult to adjust the length or width of the transmission line.

When the patch antenna 5A is attached to a metal housing after being installed in a product (e.g., a seat monitor as mentioned above), there may occur a case that the frequency characteristic of the patch antenna 5A shifts to the high-frequency side or the low-frequency side. In this case, when the resonance frequency is shifted to the low-frequency side, the frequency range can be returned to the original range by decreasing the width of the transmission line. When the resonance frequency is shifted to the high-frequency side, the frequency range can be returned to the original range by increasing the width of the transmission line. That is, even after the patch antenna is installed in a product, in the patch antenna 5A according to the third embodiment, the degree of freedom of the manner of impedance matching is high. Furthermore, since the patch antenna 5A has the two-layer structure, it can be manufactured more easily and the cost can be made lower than in the case of the three-layer structure.

Also in the third embodiment, as in the second embodiment, it goes without saying that combinations of an antenna surface and a power supply surface of two or more respective bands may be provided in the same substrate and, in this case, the same advantages as in the second embodiment can be obtained.

Although the various embodiments have been described above with reference to the accompanying drawings, it goes without saying that the disclosure is not limited to those examples. It is apparent that those skilled in the art could conceive various changes, modifications, replacements, additions, deletions, or equivalents within the confines of the claims, and they are naturally construed as being included in the technical scope of the disclosure. And constituent elements of the above-described various embodiments may be combined in a desired manner without departing from the spirit and scope of the invention.

Although in the above-described first to third embodiments the antenna device is applied to the antenna of a transmission device for transmitting radio waves, the antenna device may be applied to the antenna of a receiving device for receiving radio waves.

The present application is based on Japanese Patent Application No. 2017-253891 filed on Dec. 28, 2017, the disclosure of which is incorporated herein by reference.

The present disclosure is useful when applied to antenna devices whose communication frequency range is widened and antenna gain is increased by decreasing the Q value indicating the sharpness of a peak of a resonance frequency characteristic without increasing the overall thickness of the antenna device itself

What is claimed is:

1. An antenna device comprising:

an antenna surface provided with an antenna conductor;

a ground surface opposed to the antenna surface and provided with a ground conductor; and a stub in which a plurality of transmission lines having different line widths are connected to each other in series, wherein:

the stub is located at a same plane as the antenna surface or between the antenna surface and the ground surface;

the stub is located within an area defined by an outer periphery of the antenna conductor in plan view from an antenna surface side of the antenna device; and a line width of a first transmission line of the plurality of transmission lines that is closest to a power supply point disposed in the stub is smaller than a line width of a second transmission line of the plurality of transmission lines that is connected to the first transmission line in series.

2. The antenna device according to claim 1, wherein the plurality of transmission lines have a same line length.

3. The antenna device according to claim 1, further comprising:

a substrate made of a dielectric, wherein:

the substrate is configured by a first substrate and a second substrate which is a layer located above the first substrate;

the ground conductor is provided on a back surface of the first substrate;

the antenna conductor is provided on a front surface of the second substrate; and the stub is provided between a front surface of the first substrate and a back surface of the second substrate.

4. The antenna device according to claim 1, further comprising:

a substrate made of a dielectric, wherein:

the antenna conductor and the stub are provided on one surface of the substrate.

5. The antenna device according to claim 1, wherein the stub has at least one bending portion for arranging portions of a same transmission line or different transmission lines so as to be parallel with each other in the plurality of transmission lines that are connected to each other in series.

6. The antenna device according to claim 1, wherein:

the antenna conductor has a plurality of antenna conductors capable of operating in different frequency bands provided on the antenna surface so as to be distant from each other; and the stub has a plurality of sub-stubs that are impedance-matched corresponding to the plurality of antenna conductors respectively.

* * * * *